US010065846B2

(12) United States Patent
Peirsman et al.

(10) Patent No.: US 10,065,846 B2
(45) Date of Patent: Sep. 4, 2018

(54) INTEGRAL KEG CONNECTOR

(71) Applicant: Anheuser-Busch InBev S.A., Brussels (BE)

(72) Inventors: Daniel Peirsman, Leuven (BE); Stijn Vandekerckhove, Leuven (BE)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 15/128,920

(22) PCT Filed: Mar. 20, 2015

(86) PCT No.: PCT/EP2015/055971
§ 371 (c)(1),
(2) Date: Sep. 23, 2016

(87) PCT Pub. No.: WO2015/144591
PCT Pub. Date: Oct. 1, 2015

(65) Prior Publication Data

US 2017/0107091 A1 Apr. 20, 2017

(30) Foreign Application Priority Data

Mar. 24, 2014 (EP) ..... 14161266

(51) Int. Cl.
*B67D 1/08* (2006.01)

(52) U.S. Cl.
CPC ..... *B67D 1/0829* (2013.01); *B67D 1/0807* (2013.01); *B67D 2001/0822* (2013.01)

(58) Field of Classification Search
CPC ..... B67D 1/0829; B67D 2001/0822
See application file for complete search history.

(56) References Cited

U.S. PATENT DOCUMENTS

| | | | |
|---|---|---|---|
| 2,128,473 | A | 8/1938 | Rice |
| 3,545,475 | A | 12/1970 | Johnson |
| 6,871,679 | B2 | 3/2005 | Last |
| 2011/0210148 | A1 | 9/2011 | Nelson et al. |

(Continued)

FOREIGN PATENT DOCUMENTS

| | | |
|---|---|---|
| DE | 95558 | 1/1898 |
| DE | 91 09 177 | 10/1991 |
| EP | 1 347 936 | 6/2002 |

(Continued)

*Primary Examiner* — Donnell Long
(74) *Attorney, Agent, or Firm* — Levy & Grandinetti

(57) ABSTRACT

A keg connector for coupling a dispensing line and gas line to a keg is disclosed having a closure with a sealed dispensing opening and gas opening. The connector has a monoblock body with a top plate structure having a perimeter, upper surface, lower surface, and clamping system. The clamping system has two clamping legs jutting from the lower surface of the top plate, and two levers jutting out of the upper surface of the top plate, each lever has a coupled end fixed to the opposite portions of the perimeter of the top plate as the hinge ends of the two legs. The connecter has a dispensing tube with an upstream portion jutting out of the lower surface of the top plate, and a gas tube with a downstream portion jutting out of the lower surface of the top plate parallel to the upstream portion of the dispensing tube.

12 Claims, 3 Drawing Sheets

(56) References Cited

U.S. PATENT DOCUMENTS

| | | | | |
|---|---|---|---|---|
| 2014/0231442 | A1* | 8/2014 | Hill | A47G 19/2266<br>220/740 |
| 2015/0210524 | A1* | 7/2015 | Witte | B29C 49/06<br>222/394 |

FOREIGN PATENT DOCUMENTS

| | | |
|---|---|---|
| EP | 2 012 052 | 1/2009 |
| FR | 1 334 267 | 9/1962 |
| GB | 2502970 | 12/2013 |
| WO | WO 94/07791 | 4/1994 |
| WO | WO 99/47451 | 9/1999 |
| WO | WO 01/07819 | 2/2001 |
| WO | WO 02/079075 | 10/2002 |
| WO | WO 2007/108684 | 9/2007 |
| WO | WO 2008/129012 | 10/2008 |
| WO | WO 2008/129013 | 10/2008 |
| WO | WO 2008/129015 | 10/2008 |
| WO | WO 2008/129016 | 10/2008 |
| WO | WO 2008/129018 | 10/2008 |
| WO | 2 452 914 | 5/2012 |
| WO | WO 2012/056018 | 5/2012 |

* cited by examiner (a)

(b)

(a)

(b)

INTEGRAL KEG CONNECTOR

TECHNICAL FIELD

The present invention relates to keg connectors for rapidly and easily connecting a beer keg to a dispensing line and to a pressurized gas line. It concerns in particular a cheap, re-usable keg connector adapted to the new evolution of beer keg designs.

BACKGROUND FOR THE INVENTION

When beer or malt based fermented beverages (collectively referred to herein as "beer") are widely distributed stored in bottles and metal cans, there is a marked preference by the public for beers served directly on tap from a keg, referred to as draught (or draft) beer. Since draught beer was traditionally served in large volumes in public houses (pubs) and restaurants, large capacity metal kegs were traditionally used, typically 50 l kegs (=11 Imperial gallons). In recent years, however; a reduction of the kegs capacity offered on the market has been observed. There are two main factors explaining this trend.

First, brewers have developed various solutions for offering draught beer to particulars with specifically designed home appliances. It is clear that if 50 l kegs can be emptied reasonably rapidly in a pub, this is not the case for home appliances. Hence, smaller kegs of 5 to 15 l capacity were developed. Such home appliances are often referred to as "table top dispensers" because they are small enough to stand on top of a table.

Second, even in pubs, the tastes of the consumers have shifted from traditional lager beers towards special beers, with more specific flavours. This diversification of the types of beers offered for consumption in pubs has pushed brewers to store their special beers in smaller capacity kegs, ranging from 8 to 25 l kegs. Since such kegs are too large to stand on top of a counter, and probably too small to justify storing them in a basement far away from the tap, they are usually stored directly under the tapping column, usually in a refrigerated chamber. For this reason and by opposition to the expression "table top dispensers", such dispensing systems used in pubs are often referred to as "under the counter dispensers".

With the reduction of kegs capacity, however, the cost of packaging (=keg) per litre of beer sold increased accordingly. Alternative solutions to metal kegs had to be developed, typically replacing metal kegs by polymeric kegs made for example of PET. Furthermore, since draught beers require a pressurized gas to drive the dispensing of the beer out of the keg, and pressurized $CO_2$ bottles used in pubs are not readily available for home appliances, solutions were proposed to use air compressors as source of pressurized gas instead. To avoid any contact between air and the beer, dispensing bag-in-containers have been used, wherein the beer is contained in a flexible inner bag inserted in an outer, rigid container, and pressurized gas is injected into the space between the inner bag and outer container to collapse the inner bag and drive the beer out of the bag. As illustrative examples, integrally blowmoulded polymeric dispensing bag-in-containers are disclosed in WO2008129018, WO2008129016, WO2008129012, WO2008129015, or WO2008129013, which contents are herein incorporated by reference.

Regardless of its size, before use a beer keg must be connected to a dispensing line and to a source of pressurized gas. Home appliances have been designed with their own specific solution for rapidly connecting a dispensing line and a gas source to the interior of the kegs (cf. e.g., WO2012056018). In some cases, the source of pressurized gas is stored in the keg itself, but this solution is rather expensive and to date implementable in quite small kegs only (cf. e.g., WO9947451, WO2007/108684). In pubs, however, although the kegs designs have changed dramatically as discussed above, the same equipment as for large 50 l kegs is often still being used downstream from the keg, including the keg connector, the dispensing line and gas duct, and draught column and tap. Conventional keg connectors are usually made of metal, are heavy, complex and expensive. Examples of conventional keg connectors are disclosed in WO9407791, U.S. Pat. No. 3,545,475, DE91 091 77U. They are ill-fitted for smaller polymeric kegs, typically of 8 to 25 l kegs. Some solutions have been proposed to replace conventional keg connectors with simpler connectors.

WO2007/108684 discloses a simplified keg connector comprising a single connection to a dispensing tube. The keg connector could be designed without a connection to a pressurized gas tube because the pressurized gas source is stored in a container located inside the keg. Absent a connection to a pressurized gas source, the requirements, in particular mechanical, clamping, and sealing properties, on the keg connector are substantially reduced, and the size thereof could be reduced accordingly. Numerous connectors for coupling a single dispensing duct to a container comprising no pressurized gas connection have been disclosed in fields other than beer kegs, such as in U.S. Pat. No. 6,871,679, EP2012052, or WO200107819, but are not suitable for a quick connection of a beer keg to both a dispensing line and a pressurized gas source.

FR1334267 and WO02079075 disclose keg connectors which are as bulky and complex as conventional keg connectors. EP1347936 discloses a small size keg connector comprising a connection to both a source of pressurized gas and a dispensing tube. The keg connector of EP1 347936, however, is not connected to a closure of the keg, as it acts as a closure per se. Each new keg is sold with such connector already clamped into position with a new dispensing line coupled thereto. A keg connector concomitantly acting as closure is also disclosed in US2011210148, but in this case, the connector is reversibly coupled to a container by a thread and can be removed therefrom and used with a new container.

There remains a need in the art for re-usable keg connectors adapted for small size kegs (e.g., 8 to 25 l capacity), generally made of polymer, which are cheap, light, safe and easy to connect to a new keg and disconnect to a spent keg. The present invention proposes such keg connector. These and other advantages are discussed more in details in the following sections.

SUMMARY OF THE INVENTION

The present invention is defined in the appended independent claims. Preferred embodiments are defined in the dependent claims. In particular, the present invention concerns a keg connector for coupling a dispensing line and a gas line to a keg comprising a closure provided with a sealed dispensing opening and with a gas opening, said keg connector comprising:

(a) A mono-block integral body comprising a top plate structure defined by a perimeter and comprising an upper surface (2*t*) and a lower surface and being provided with a clamping system for reversibly coupling the keg connector to the closure of a keg, said clamping system comprising;

(i) Two clamping legs jutting out of the lower surface of said top plate structure, each of said clamping legs having a hinge end integrally linked to two opposite portions of the perimeter of said top plate structure and a free end opposite the hinge end and comprising at least one protrusion extending towards the free end of the other leg, (ii) Two levers jutting out of the upper surface of said top plate structure, each of said levers having a coupled end integrally fixed at the same two opposite portions of the perimeter of the top plate structure as the hinge ends of the two legs, and a free end, such that pressing the distal free ends of the two levers towards one another reversibly and resiliently drives the two free ends of the clamping legs away from one another, (b) A dispensing tube comprising a lumen bringing in fluid communication an upstream end located at the end of an upstream portion of the dispensing tube and a downstream end located at the end of a downstream portion of the dispensing tube, said upstream portion of the dispensing tube having an outer diameter matching the size of the dispensing opening of a closure for insertion therein, and jutting transversally out of the lower surface of the top plate structure and being rigid such as to be able to break the seal of the dispensing opening by pressing thereon, and (c) A gas tube comprising a lumen bringing in fluid communication an upstream end located at the end of an upstream potion of the gas tube and a downstream end located at the end of a downstream portion of the gas tube, said downstream portion of the gas tube having an outer diameter matching the size of the gas opening of a closure for insertion therein, and jutting transversally out of the lower surface of the top plate structure substantially parallel to the upstream portion of the dispensing tube.

In a preferred embodiment, the downstream portion of the dispensing tube forms an angle of 70 to 120°, preferably of 80 to 100°, with the upstream portion of the dispensing tube. Alternatively or concomitantly, the upstream portion of the gas tube forms an angle of 70 to 120°, preferably of 80 to 100°; with the downstream portion of the gas tube The downstream portion of the dispensing tube can be reversibly detachable from the upstream portion of the dispensing tube. Alternatively or concomitantly, the upstream portion of the gas tube can be reversibly detachable from the downstream portion of the gas tube.

In an alternative embodiment, the dispensing tube is an integral part of the mono-block integral body. Alternatively or concomitantly, the gas tube is an integral part of the mono-block integral body.

Both or anyone of each of the downstream end of the dispensing tube and the upstream end of the gas tube may comprise a connection element in order to facilitate the coupling thereof to a dispensing line and gas line, respectively.

In an embodiment particularly suitable for use with dispensing bag-in-containers, the upstream portion of the dispensing tube is located substantially at the geometrical centroid of the perimeter of the inner surface of the top plate structure, and the downstream portion of the gas tube is located close to the perimeter of the inner surface of the top plate structure.

The present invention also concerns an assembly of a a keg connector as defined above coupled to a container containing a beverage, wherein the container comprises a body portion and a neck portion provided with an opening sealed by a closure comprising a dispensing opening and a gas opening, characterized in that, the upstream portion of the dispensing tube is inserted in the dispensing opening of the closure and the downstream portion of the gas tube is inserted in the gas opening of the closure, and in that, the keg connector is reversibly maintained in coupling position by the two clamping legs. The closure generally comprises a skirt ending in a circumferential ridge. In one embodiment the keg connector is reversibly maintained in coupling position by clamping the protrusions at the free ends of the clamping legs beyond said circumferential ridge. In an alternative embodiment, the neck of the container comprises a circumferential ring forming a ledge around the circumference of the neck region, and wherein the keg connector is reversibly maintained in coupling position by clamping the protrusions at the free ends of the clamping legs beyond said circumferential ring.

In a preferred embodiment, the assembly of the present invention is used in a dispensing unit usually found in most pubs and bars, with the downstream end of the dispensing tube being fluidly connected to an upstream end of a dispensing line. The dispensing line comprises a free downstream end and is coupled to a tapping valve situated between the upstream and downstream ends of the dispensing line (15). The upstream end of the gas tube is fluidly connected to a downstream end of a gas line, said gas line comprising an upstream end connected to a source of pressurized gas.

The present invention also concerns a method for connecting or disconnecting a keg to a tapping valve comprising the following steps:

(a) providing a keg connector as defined above and a container extending along a longitudinal axis from a base to a neck portion, the base being separated from the neck portion by a body portion, and the neck portion being provided with an opening sealed by a closure comprising a sealed dispensing opening and a gas opening, (b) fluidly connecting the upstream end of the gas tube to a source) of pressurized gas, (c) fluidly connecting the downstream end of the dispensing tube to a dispensing line and coupling said dispensing line to a tapping valve, and (d) pressing the keg connector against the closure along the longitudinal direction such as to insert the upstream portion of the dispensing tube and the downstream portion of the gas tube into the corresponding dispensing opening and gas opening, respectively, breaking open in the process the seal of the dispensing opening, until the protrusions of the free ends of the clamping legs snap fit into a coupling position with the closure of the container to obtain an assembly as discussed above.

The keg connector thus coupled to a keg can be disconnected from the keg as follows:

Shutting the fluid communication between the source of pressurized gas and the gas tube;

pressing the two levers towards one another with one hand such as to drive the two free ends and their corresponding protrusions of the clamping legs away from one another, and pulling the connector away from the closure along the longitudinal axis.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1:
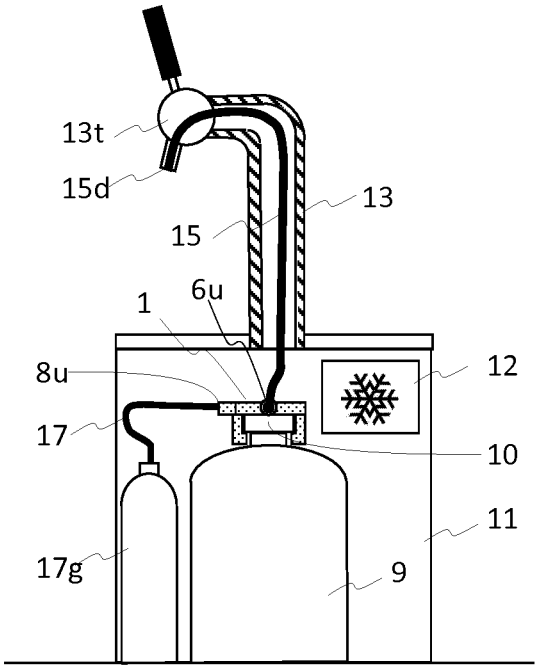
FIG. 1: Illustrates a beer keg stored in a cooled closet, comprising a keg connector connecting said keg to a dispensing line and to a pressurized gas line.
Figure 4:
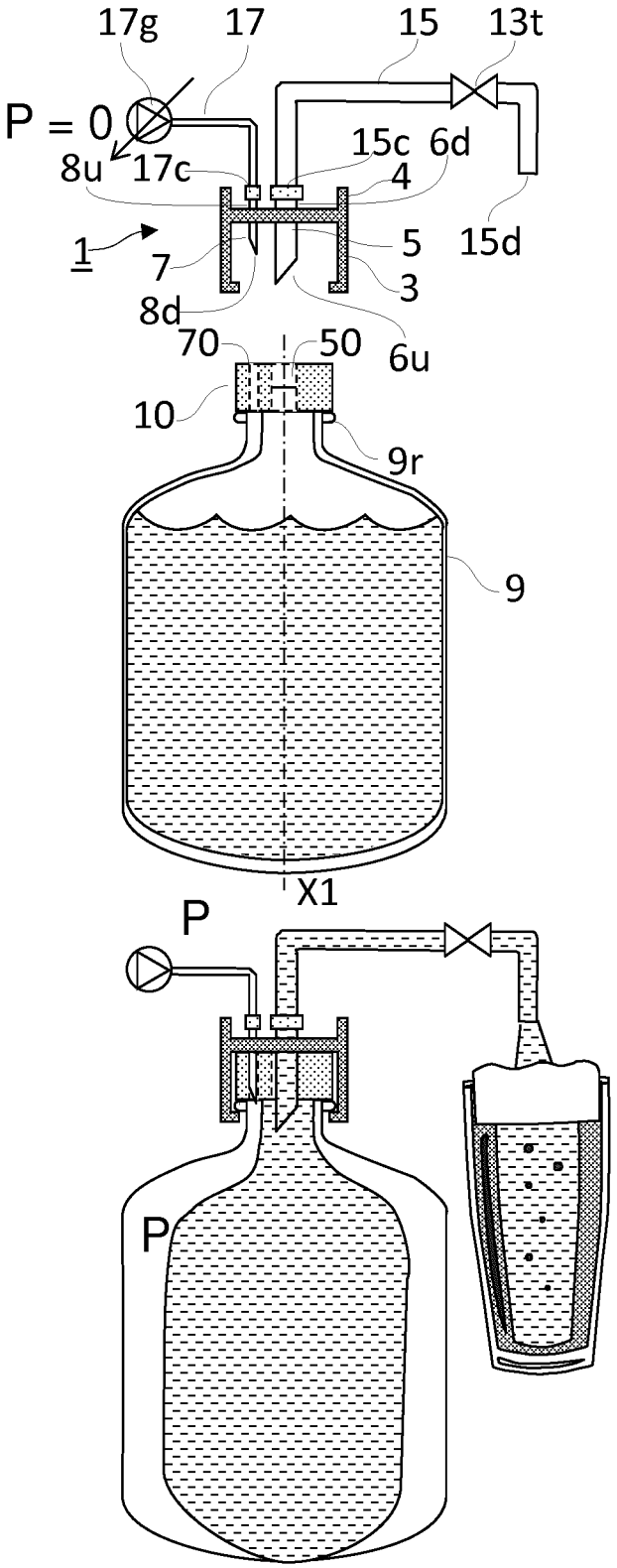
FIG. 4: shows a dispensing bag-in-container comprising a closure (a) before and (b) after connection to a dispensing line and to a gas line by means of a keg connector according to the present invention.

As shown in FIGS. 1 and 4(*b*) the present invention concerns dispensing containers or kegs (9) containing a liquid, typically a beverage, such as beer or other carbonated beverages, to be dispensed through a dispensing line (15) controlled by a tapping valve (13*t*) and driven by a pressurized gas injected into the container. The source (17*g*) of pressurized gas can be a pressurized bottle containing a gas under high pressure, a gas compressor, and/or a gas adsorbed on a solid adsorbent. Depending on the type of container (9) and of the liquid contained therein, the gas can be air, carbon dioxide, nitrogen or the like.

The container or keg (9) (the two terms being herein considered as equivalent) generally extends along a longitudinal axis, X1, from an opening sealed by a closure (10) to a base. The opening is comprised in a substantially cylindrical neck region, which is separated from a body portion, usually substantially cylindrical of larger diameter than the neck region, by a shoulder forming a transition region, and the body portion is adjacent to the base. The container (9) can be a traditional keg, wherein the pressurized gas is injected into the same volume which contains the liquid. In this case, a dispensing hollow spear is generally used with one end dipped at the lowest part of the liquid in a direction parallel to the gravitational field when in use and the other end coupled to a dispensing opening (50) of a closure sealing the opening of the keg. Alternatively, the keg (9) can be a dispensing bag-in-container as illustrated in FIG. 4 and disclosed in WO2008129018, WO2008129016, WO2008129012, WO2008129015, or WO2008129013, which contents are herein incorporated by reference, wherein a flexible inner bag is coupled to an outer container at the neck region and contains the liquid to be dispensed. A vent between the inner bag and the outer container allows pressurized gas to be injected between the inner bag and the outer container to delaminate and collapse the inner bag and thus dispense the liquid contained therein (cf. FIG. 4(*b*)).

The connection of a dispensing line (15) and a gas line (17) to the keg (9) is made very rapid, easy, and comfortable with the use of a keg connector (1) according to the present invention. A keg connector of the present invention can be used several times with different kegs, and is extremely cheap to produce and easy to use. In particular, a keg connector (1) according to the present invention comprises a mono-block integral body comprising, on the one hand, a top plate (2) structure defined by a perimeter and comprising an upper surface (2*t*) and a lower surface (2L) and, on the other hand, a clamping system. The integral mono-block body is preferably made of a polymer, more preferably, but not necessarily, a thermoplastic polymer such as a polyolefin (e.g., PE, PP), a polyamide (e.g., PA6, PA66, PA12), a polyester (e.g., PET, PEN) and the like. It is advantageously injection moulded. For smaller series, 3D-printers can be used to produce the mono-block integral body (2). The mono-block integral body comprises an integral clamping system for reversibly coupling the keg connector to the closure of a keg. The clamping system comprises:

(a) two clamping legs (3) jutting out of the lower surface (2L) of said top plate structure (2), each of said clamping legs having a hinge end (3*h*) integrally linked to two opposite portions of the perimeter of said top plate structure (2) and a free end (3*f*) opposite the hinge end and comprising at least one protrusion (3*p*) extending towards the free end of the other leg, and (b) two levers (4) jutting out of the upper surface (2*t*) of said top plate structure (2), each of said levers having a coupled end (4*c*) integrally fixed at the same two opposite portions of the perimeter of the top plate structure (2) as the hinge ends of the two legs, and a free end (4*f*), such that pressing the distal free ends of the two levers towards one another reversibly and resiliently drives the two free ends (3*f*) of the clamping legs (3) away from one another.

The keg connector (1) further comprises:

a dispensing tube (5) comprising a lumen bringing in fluid communication an upstream end (6*u*) located at the end of an upstream portion (5*u*) of the dispensing tube and a downstream end (6*d*) located at the end of a downstream portion (5*d*) of the dispensing tube; said upstream portion (5*u*) of the dispensing tube has an outer diameter matching the size of the dispensing opening of a closure for insertion therein, and juts transversally out of the lower surface (2L) of the top plate structure and is rigid such as to be able to break the seal of the dispensing opening by pressing thereon, and a gas tube (7) comprising a lumen bringing in fluid communication an upstream end (8*u*) located at the end of an upstream potion (7*u*) of the gas tube and a downstream end (8*d*) located at the end of a downstream portion (7*d*) of the gas tube; said downstream portion (7*d*) of the gas tube has an outer diameter matching the size of the gas opening of a closure for insertion therein, and juts transversally out of the lower surface (2L) of the top plate structure substantially parallel to the upstream portion (5*u*) of the dispensing tube (5).

As shown in FIG. 4, the keg connector (1) of the present invention can be coupled to the closure (10) of a keg (9) by simply pressing it onto said closure in a direction parallel to a longitudinal axis, X1, of the keg. At rest, the protrusions (3*p*) at the respective free ends (3*f*) of the clamping legs (3) are separated by a rest distance, d0. Upon pressing the keg connector onto the closure, the clamping legs (3) must pass through at least a broad section spanning a distance normal to the longitudinal axis, d1>d0, so that the clamping legs must be flexed slightly until the protrusions (3*p*) are separated by a distance, d1, to pass through said broad section. The keg connector reaches its coupling position when the protrusions (3*p*) have passed just beyond said broad section and are able to snap back into their rest position separated by a distance, d0, resting adjacent the broad section. The broad section can be the closure (10) itself which comprises a skirt (10*s*) and the clamping legs are able to snap back into their rest position when the protrusions reach the ridge (10*r*) of the closure skirt. The keg connector is thus coupled to the closure (10) which is itself coupled to the keg (9). Alternatively, the keg (9) comprises a circumferential ring (9*r*) forming a ledge around the circumference of the neck region. Said circumferential ledge forms the broad section over which the clamping legs must be flexed to pass further and can snap back into their rest position once the protrusions (3*p*) have passed beyond the ring (9*r*) (cf. FIG. 4(*b*)).

As the clamping legs (3) are sliding along the closure skirt (10*s*) the upstream portion (5*u*) of the dispensing tube (5) and the downstream portion (7*d*) of the gas tube (7) are concomitantly introduced into the dispensing opening (50) and gas opening (70), respectively, of the closure (10), the upstream end (6*u*) of the dispensing tube (5) breaking open the sealed dispensing opening (50) in the process. For this reason, the upstream portion (5*u*) of the dispensing tube (5) and the downstream portion (7*d*) of the gas tube (7) must be parallel to one another, and must be parallel to the longitudinal axis, X1, when the keg connector is moved into coupling position.

Figure 2:
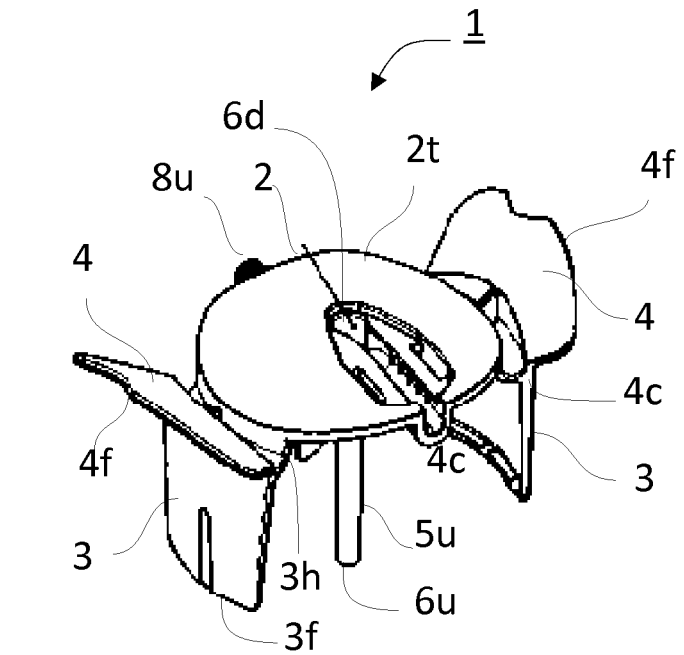
FIG. 2: illustrates a closure suitable for use with a keg connector according to the present invention.
Figure 2:
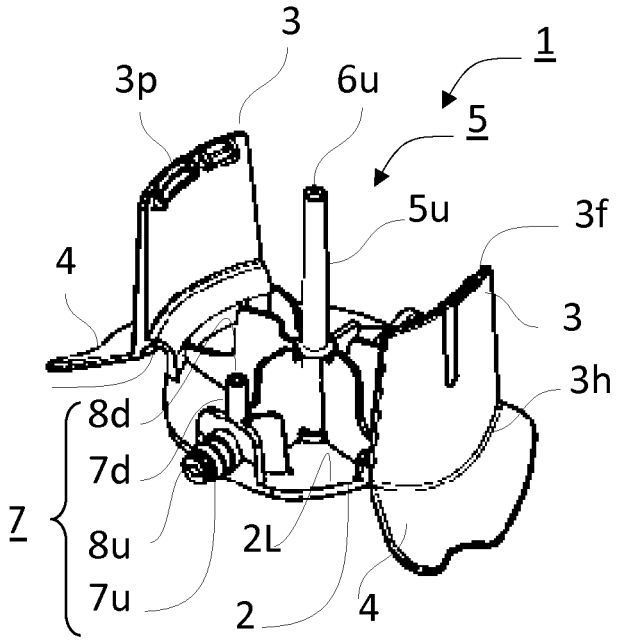

In a preferred embodiment illustrated in FIGS. 1 and 2, the upstream portion (7*u*) of the gas tube (7) forms an angle of 70 to 120°, preferably of 80 to 100°; with the downstream portion (7*d*) of the gas tube. In a more preferred embodiment the upstream portion (7*u*) and downstream portion (7*d*) of the gas tube (7) are substantially normal. This allows a lateral connection of the gas line (17) to the keg connector which, depending on the configuration of the closet (11) in which the keg can be stored when in use can be convenient to save room.

Similarly, the downstream portion (5*d*) of the dispensing tube (5) can form an angle of 70 to 120°, preferably of 80 to 100°; more preferably about 90° with the upstream portion (5*u*) of the dispensing tube. This configuration has the same advantage of saving space as the gas tube (7) discussed supra. It has the drawback, however, that it is more difficult to wash a lumen forming a relatively sharp elbow than a straight lumen. This drawback does not affect the gas tube which needs not be washed as thoroughly as the dispensing tube before use with a new keg. In case a lateral connection of the dispensing line (15) is desired, but it is preferred to not have a dispensing tube (5) forming an angle, it is possible, as illustrated in FIG. 2, to provide a straight dispensing tube (5) with a downstream end (8*d*) located flush with, or even slightly in recess of the upper surface (2*t*) of the top plate (2) structure. As visible in FIG. 2(*a*), a channel can be provided to accommodate the upstream portion of a dispensing line (15) ending with a L-shaped connector (15*c*). After use, the dispensing line (15), which is very difficult to wash satisfactorily, is normally removed and replaced by a new one, whilst the straight and relatively short lumen of the dispensing tube (5) of the keg connector can easily be thoroughly washed before use with a new keg. Note that in an alternative embodiment illustrated in FIG. 4, the downstream portion (5*d*) of the dispensing tube (5) and/or the upstream portion (7*u*) of the gas tube (7) can be coaxial with their respective upstream portion (5*u*) and downstream portion (7*d*), respectively.

In an embodiment of the present invention, the dispensing tube (5) and/or the gas tube (7) or at least a portion of said dispensing and/or gas tubes is distinct from the mono-block integral body, and can be removably assembled thereto. This configuration is advantageous in that, in particular the dispensing tube needs not be washed before a new use but can simply be removed and replaced by a new one. This allows the use of dispensing and/or gas tubes (5, 7) having a relatively sharp angles, with simple dispensing and/or gas lines (15, 17) comprising no specific end geometry, contrary to the L-shaped upstream end of the dispensing line (15) discussed with respect of the foregoing embodiment. A simple flexible polymeric pipe can thus be used as dispensing or gas line (15, 17), which decreases the cost of a disposable element of the dispensing unit.

In an alternative embodiment, illustrated in FIG. 2, the whole keg connector is made of a single monolithic, integral block including the top plate (2) structure with its clamping legs (3) and levers (4), as well as the dispensing tube (5) and the gas tube (7) in their entirety, including both upstream and downstream portions thereof.

Figure 3:
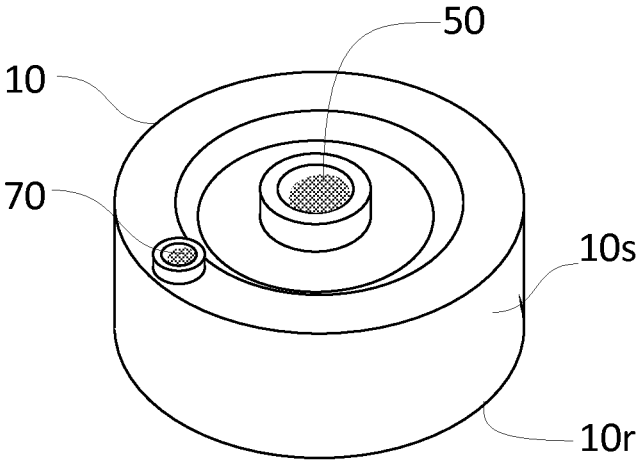
FIG. 3: shows a perspective (a) top view and (b) bottom view of a keg connector according to the present invention.

In an embodiment particularly suitable for use with dispensing bag-in-containers, the upstream portion (5*d*) of the dispensing tube (5) is located substantially at the geometrical centroid of the perimeter of the inner surface of the top plate structure (2), and the downstream portion (7*d*) of the gas tube (7) is located close to the perimeter of the inner surface of the top plate structure (2). As shown in FIGS. 3&4 this configuration is well suited for bag-in-containers wherein pressurized gas is injected between the inner layer forming a flexible, collapsible bag containing the liquid to be dispensed, and the outer container. For this reason, the gas opening (70) in a closure (10) used with such bag-in-containers is conveniently located at the level of the rim defining the perimeter of the mouth of the container where a vent can be located. The dispensing opening can be anywhere else over the mouth of the container, and is conveniently located at the centre thereof.

In case of traditional dispensing kegs, wherein pressurized gas, generally CO2, is injected into the volume containing the liquid to be dispensed through a hollow spear, the dispensing tube (5) is advantageously located close to the centroid of the top plate (2) structure, whilst the gas tube (7) should not be too close to the perimeter thereof, since it must correspond to a gas opening (70) of a closure which is located over the opening of the keg. In some instances, the gas duct (7) and dispensing duct (5) may be concentric, with the downstream portion (7*d*) of the gas duct (7) being enclosed within the upstream portion (5*u*) of the dispensing tube (5).

When a keg connector (1) according to the present invention is reversibly coupled to a keg (9), it is is maintained in its coupled position by means of the clamping legs (3) snap-fitted beyond a broad section of the keg, which can be formed by the circumferential ridge (10*r*) forming the free end of the closure skirt (10*s*) or, alternatively by a circumferential ring (9*r*) formed at the neck region of the keg (9). In its coupled position, the upstream portion (5*u*) of the dispensing duct (5) is engaged in the dispensing opening (50) of the closure (with the seal thereof broken open upon introduction of the upstream end (6*u*) of the dispensing tube (5)) and the downstream portion (7*d*) of the gas tube (7) is engaged in the gas opening (70) of the closure. The terms "downstream" and "upstream" are used herein with reference to the flow direction of a fluid in the corresponding tubes (viz., liquid in the dispensing tube (5) flowing out of the container, and pressurized gas flowing in the gas tube (7) into the container).

The downstream end (6*d*) of the dispensing tube (5) must be connected to an upstream end of a dispensing liner (15); which comprises a free downstream end (15*d*) and is coupled to a tapping valve (13*t*) located between the upstream and downstream ends of the dispensing lines. In a preferred embodiment illustrated in FIG. 1, the assembly formed by a keg (9) and a keg connector (1) according to the present invention is used in a tapping system as can be found in bars and pubs. The keg can be stored under the counter, preferably in a closet (11) comprising a cooling system (12) for refrigerating the beverage (e.g., beer) contained in the keg. The dispensing line (15) runs from the downstream end (6*d*) of the dispensing tube (5) of the keg connector, through a tapping column and is coupled to a tapping valve system (13*t*) which can be, for example, a pinch valve as disclosed e.g., in EP2452914.

Similarly, when the keg connector (1) is in its coupled position with the keg, the downstream portion (7*d*) of the gas tube (7) is inserted in the gas opening (70) of the closure (10). The upstream end (8*u*) of the gas tube (7) is connected to a gas line (17) which is coupled to a source (17*g*) of pressurized gas, such as a bottle containing gas under high pressure (cf. FIG. 1), or to a compressor (cf. FIG. 4). Injection of pressured gas into the keg (9) through the gas line (17) and gas tube (7) drives the flow of liquid contained in the keg through the dispensing tube (5) and dispensing line (15) to the tapping valve (13*t*).

When the latter is open, the liquid is free to flow out of the downstream end (15*d*) of the dispensing line (15) into a glass or any other recipient (cf. FIG. 4(*b*)). FIG. 4 shows the example of a dispensing bag)-in-container which dispensing mechanism has been discussed supra. In case of a traditional keg, a spear is required to lead the flow of liquid from the most remote portion of the container from the keg opening in a direction parallel to the gravity field when the keg is in dispensing position (i.e., if the keg stands up vertical with its opening at the highest point, then the spear must reach close to the base of the container. If the keg is held in a tilted position, then the free end of the spear must reach the lowest point of the keg. If the keg is held vertically with its opening facing downwards, then no spear is needed). But with such configuration, injection of a pressurized gas is generally not necessary since dispensing is driven by gravity.

A keg connector according to the present invention can be used repeatedly with different kegs (9) and is not disposable with each single keg. For this reason, it must be easily removable from an empty keg in order to the coupling thereof to a new keg. To facilitate the removal of a keg connector from an empty keg, the keg connector comprises two levers (4) which are a continuation of the clamping legs (3) extending on the opposite surface of the top plate structure (2), at the upper surface (2*t*) thereof. After closing the communication between the keg and the source (17*g*) of pressurized gas, the keg connector (1) can be easily removed by pressing the free ends (4*f*) of the two levers (4) towards one another, so that the protrusions (3*p*) at the free ends (3*f*) of the clamping legs (3) are driven away from each other, to a distance of d1 or greater. In such configuration, the keg connector can be removed along the longitudinal axis, X1, and can pass over the broad section without hindrance. After some washing, the keg connector is ready for use with a new keg.

A keg connector (1) according to the present invention is extremely cheap to produce and can be used repeatedly with several kegs. It is very simple and rapid to use, requiring no complex movements of twisting or rotating for reversibly coupling it to a keg, but a simple translation along the longitudinal axis of the container suffices until the clamping legs (3) snap fit into position, with the dispensing tuber (5) and gas tube (7) engaged in the respective dispensing opening (50) and gas opening (70) of the keg closure (10). It is very compact, taking very little room when coupled to a keg. The removal thereof is very easy too, making it a perfect replacement to the conventional bulky keg connectors or to the disposable, single use connectors of the prior art.

The following table lists the reference numbers used in the Figures.

| # | Description |
|---|---|
| 1 | keg connector |
| 2 | top plate structure |
| 2L | lower surface of top plate structure 2 |
| 2t | upper surface of top plate structure 2 |
| 3 | clamping leg |
| 3f | clamping leg free end |
| 3h | clamping leg hinge end |
| 3p | clamping leg protrusion |
| 4 | lever |
| 4c | lever coupled end |
| 4f | lever free end |
| 5 | dispensing tube |
| 5d | downstream portion of dispensing tube |
| 5u | upstream portion of dispensing tube |
| 6d | downstream end of dispensing tube |
| 6u | upstream end of dispensing tube |
| 7 | gas tube |
| 7d | downstream portion of gas tube |
| 7u | upstream portion of gas tube |
| 8d | downstream end of gas tube |
| 8u | upstream end of gas tube |
| 9 | keg, container |
| 10 | closure |
| 11 | keg closet |
| 12 | cooling system |
| 13 | tapping column |
| 13t | tap valve |
| 15 | dispensing line |
| 15c | connection element between dispensing line 15 and dispensing tube 5 |
| 15d | downstream end of dispensing line |
| 17 | gas line |
| 17c | connection element between gas line 17 and gas tube 7 |
| 17g | source of pressurized gas |
| 50 | dispensing opening of closure 10 |
| 70 | gas opening of closure 10 |

The invention claimed is:

1. A keg connector for coupling a dispensing line and a gas line to a keg comprising a closure provided with a sealed dispensing opening and with a gas opening, said keg connector comprising:

a mono-block integral body comprising a top plate structure defined by a perimeter and comprising an upper surface and a lower surface and being provided with a clamping system for reversibly coupling the keg connector to the closure of a keg, said clamping system comprising;

(i) two clamping legs jutting out of the lower surface of said top plate structure, each of said clamping legs having a hinge end integrally linked to two opposite portions of the perimeter of said top plate structure and a free end opposite the hinge end and comprising at least one protrusion extending towards the free end of the other leg, (ii) two levers jutting out of the upper surface of said top plate structure, each of said levers having a coupled end integrally fixed at the same two opposite portions of the perimeter of the top plate structure as the hinge ends of the two clamping legs, and a free end, such that pressing the free ends of the two levers towards one another reversibly and resiliently drives the two free ends of the clamping legs away from one another, a dispensing tube comprising a lumen bringing in fluid communication an upstream end located at the end of an upstream portion of the dispensing tube and a downstream end located at the end of a downstream portion of the dispensing tube, said upstream portion of the dispensing tube having an outer diameter matching the size of the dispensing opening of a closure for insertion therein, and jutting transversely out of the lower surface of the top plate structure and is rigid such as to be able to break the seal of the dispensing opening by pressing thereon, and a gas tube comprising a lumen bringing in fluid communication an upstream end located at the end of an upstream portion of the gas tube and a downstream end located at the end of a downstream portion of the gas tube, said downstream portion of the gas tube having an outer diameter matching the size of the gas opening of a closure for insertion therein, and jutting transversely out of the lower surface of the top plate structure substantially parallel to the upstream portion of the dispensing tube.

2. The keg connector according to claim 1, wherein, the downstream portion of the dispensing tube forms an angle of 70 to 120° , preferably of 80 to 100; with the upstream portion of the dispensing tube, and/ or the upstream portion of the gas tube forms an angle of 70 to 120° , preferably of 80 to 100; with the downstream portion of the gas tube.

3. The keg connector according to claim 2, wherein, the downstream portion of the dispensing tube is reversibly detachable from upstream portion of the dispensing tube, and/or the upstream portion of the gas tube is reversibly detachable from downstream portion of the gas tube.

4. The keg connector according to claim 1, wherein, the dispensing tube is an integral part of the mono-block integral body, and/or the gas tube is an integral part of the mono-block integral body.

5. The keg connector according to claim 1, wherein, the downstream end of the dispensing tube comprises a connection element at the downstream end thereof, and/or the upstream end of the gas tube comprises a connection element at the upstream end thereof.

6. The keg connector according to claim 1, wherein the upstream portion of the dispensing tube is located substantially at the geometrical centroid of the perimeter of the lower surface of the top plate structure, and the downstream portion of the gas tube is located within the perimeter of the lower surface of the top plate structure.

7. An assembly of a keg connector according to claim 1 coupled to a container containing a beverage, wherein the container comprises a body portion and a neck portion provided with an opening sealed by a closure comprising a dispensing opening and a gas opening, wherein, the upstream portion of the dispensing tube is inserted in the dispensing opening of the closure and the downstream portion of the gas tube is inserted in the gas opening of the closure, and wherein the keg connector is reversibly maintained in coupling position by the two clamping legs.

8. The assembly according to claim 7, wherein the closure comprises a skirt ending in a circumferential ridge, and wherein the keg connector is reversibly maintained in coupling position by clamping the protrusions at the free ends of the clamping legs below said circumferential ridge.

9. The assembly according to claim 7, wherein the neck portion of the container comprises a circumferential ring forming a ledge around the circumference of the neck portion, and wherein the keg connector is reversibly maintained in coupling position by clamping the protrusions at the free ends of the clamping legs below said circumferential ring.

10. The assembly according to claim 7, with the downstream end of the dispensing tube being fluidly connected to an upstream end of a dispensing line, said dispensing line comprising a free downstream end and being coupled to a tapping valve, and with the upstream end of the gas tube being fluidly connected to a downstream end of a gas line, said gas line comprising an upstream end connected to a source of pressurized gas.

11. A method for connecting or disconnecting a keg to a tapping valve comprising the following steps:

providing a keg connector according to claim 1 and a container extending along a longitudinal axis, X1, from a base to a neck portion, the base being separated from the neck portion by a body portion, and the neck portion being provided with an opening sealed by a closure comprising a sealed dispensing opening and a gas opening, fluidly connecting the upstream end of the gas tube to a source of pressurized gas, fluidly connecting the downstream end of the dispensing tube to a dispensing line and coupling said dispensing line to a tapping valve, and pressing the keg connector against the closure along the longitudinal direction such as to insert the upstream portion of the dispensing tube and the downstream portion of the gas tube into the corresponding dispensing opening and gas opening, respectively, breaking open in the process the seal of the dispensing opening, until the protrusions of the free ends of the clamping legs snap fit into a coupling position with the closure of the container to obtain an assembly.

12. The method according to claim 11, comprising the following steps for disconnecting the keg from the tapping valve:

shutting the fluid communication between the source of pressurized gas and the gas tube;

pressing the two levers towards one another with one hand such as to drive the two free ends and their corresponding protrusions of the clamping legs away from one another, and pull the keg connector away from the closure along the longitudinal axis, X1.

* * * * *